United States Patent [19]

Gallo

[11] Patent Number: 4,720,882

[45] Date of Patent: Jan. 26, 1988

[54] ANTISEISMIC STOP DEVICE FOR BRIDGE AND VIADUCT GIRDER STRUCTURES

[76] Inventor: Pellegrino Gallo, No. 3, Via Eleonora Duse, 00197 Rome, Italy

[21] Appl. No.: 824,062

[22] Filed: Jan. 30, 1986

[30] Foreign Application Priority Data

Feb. 4, 1985 [IT] Italy ..... 47638 A/85

[51] Int. Cl.[4] ..... E01D 19/08

[52] U.S. Cl. ..... 14/16.1; 52/167; 403/26

[58] Field of Search ..... 14/16.1, 15, 75; 52/167; 248/562, 636; 403/26; 188/316, 378, 379, 380

[56] References Cited

U.S. PATENT DOCUMENTS

| | | | |
|---|---|---|---|
| 3,806,975 | 4/1974 | Fyfe | 14/16.1 |
| 4,188,681 | 2/1980 | Tada et al. | 14/16.1 |
| 4,363,149 | 12/1982 | Kondo et al. | 14/16.1 |
| 4,462,955 | 7/1984 | Albin et al. | 248/562 X |
| 4,605,106 | 8/1986 | Fyfe et al. | 14/16.1 X |

FOREIGN PATENT DOCUMENTS

| | | | |
|---|---|---|---|
| 1269635 | 6/1968 | Fed. Rep. of Germany | 14/16.1 |

*Primary Examiner*—James A. Leppink
*Assistant Examiner*—Matthew Smith
*Attorney, Agent, or Firm*—Poms, Smith, Lande & Rose

[57] ABSTRACT

An antiseismic stop device for girder structures of bridges, viaducts and the like, in which said girder structure is simply resting on the piers, said device comprising separate stop means, one for each girder structure, respectively at a point corresponding to the movable girder and to the fixed girder, said means being placed centrally with respect to the intrados of the girder structure, and providing both means that are integral with the girder structure and means that are integral with the head of the pier, said means being coupled so that they can run through pin means and forming as a whole a member which is capable of absorbing the relative motions between the girder structure and the pier both in the static and the dynamic condition, and of counteracting the seismic shock just at the very moment it first surges up.

8 Claims, 15 Drawing Figures

Fig. 1
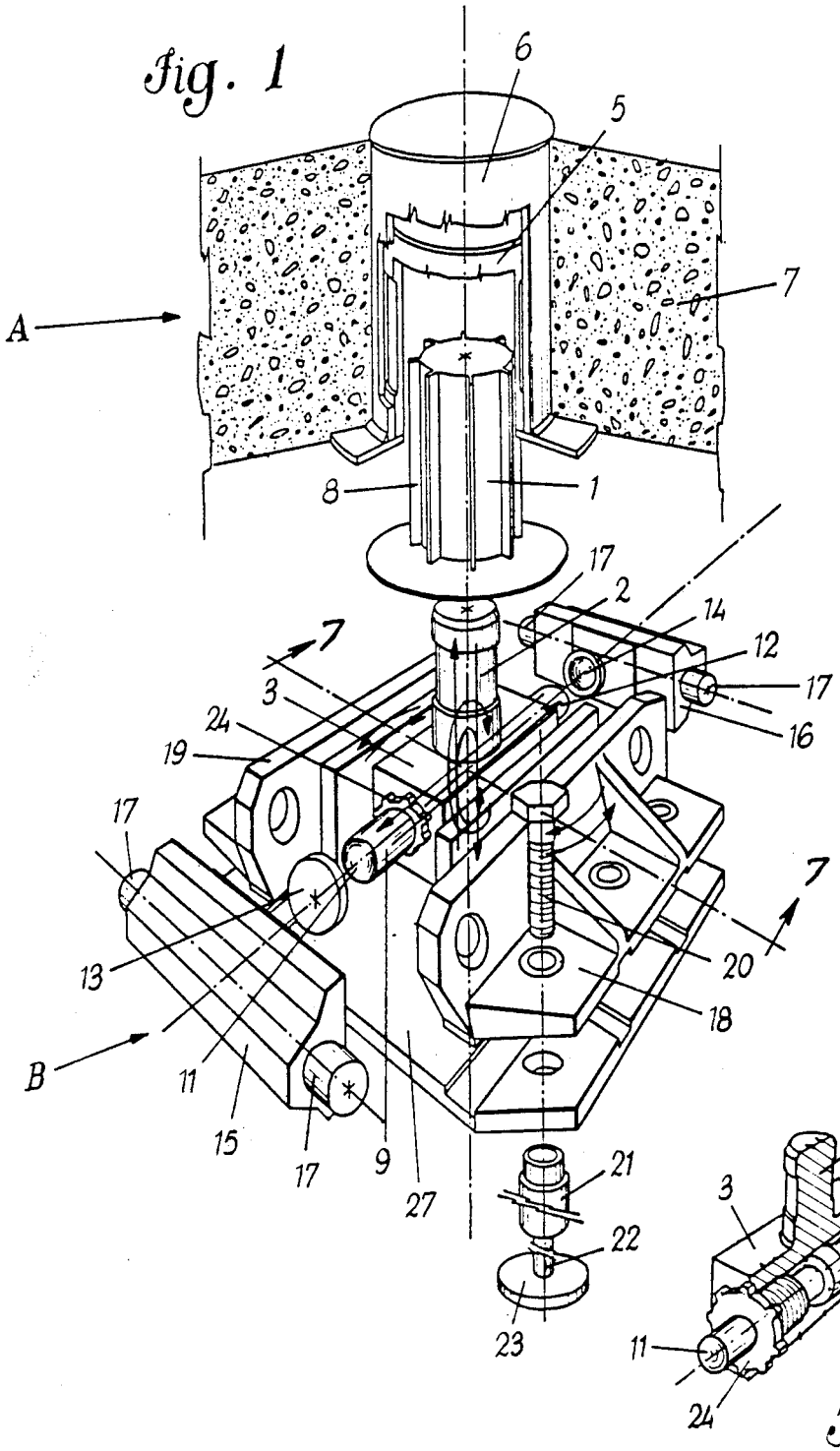
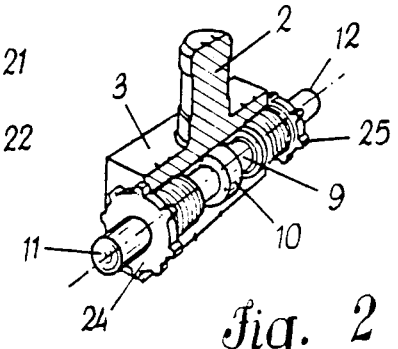
Fig. 2

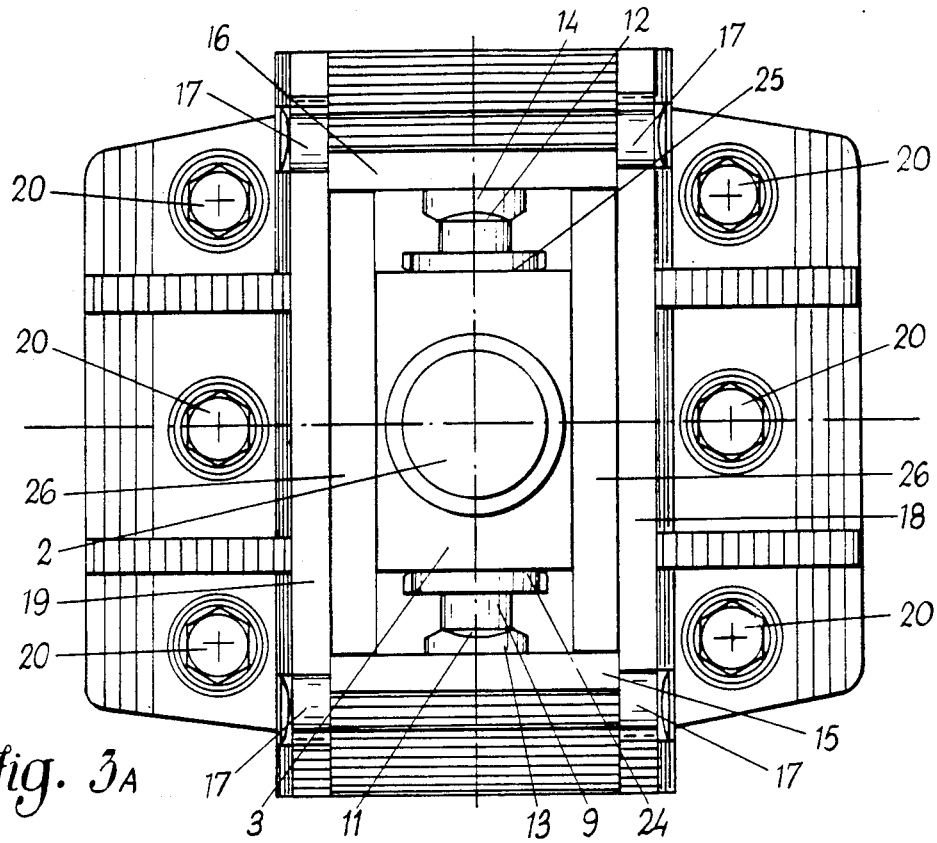
fig. 3A
fig. 3B
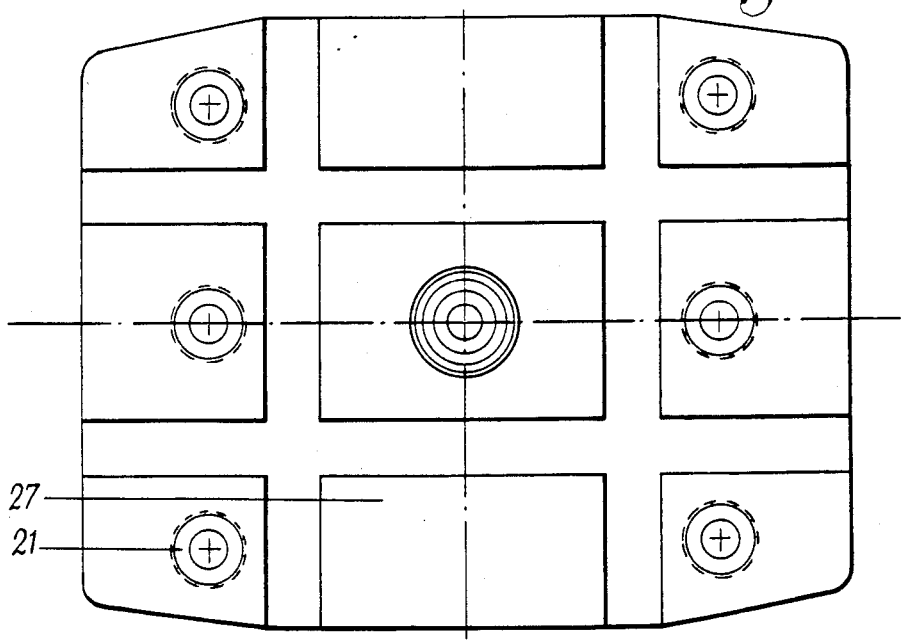

ANTISEISMIC STOP DEVICE FOR BRIDGE AND VIADUCT GIRDER STRUCTURES

DISCLOSURE OF THE INVENTION

This invention relates to an antiseismic stop device for girder structures of bridges, viaducts and the like. More particularly, this invention relates to stop devices to be employed for bridge and viaduct girder structures in seismic regions, in which constructions said girder structures are simply resting on the piers without being integral with the same. It is clearly evident that a girder structure that simply rests on piers undergoes, in the case of earthquake shocks, dangerous shifts with respect to the piers it is resting on, so damaging the resting means and the joints between one girder structure and the other ones, or breaking said means and joints.

Thus, there is the need for devices capable of:

instantaneously absorbing and counteracting the seismic shock independently of the direction it is coming from, without being subject to substantial deformations, so preventing relative motions between girder structure and head of the pier from occurring (slamming actions at the supports and joints level);

keeping active within the safety limits set forth, also in the presence of side to side and longitudinal relative motions of a remarkable value between adjacent piers;

absorbing any little shift of the girder structure occurring as a result of the rotation or the translation of the rest axis caused by accidental overloads or by shrinkage and creep thermal phenomena, so that said devices abide by the relative official regulations (Italian regulations according to the Act no. 64 of Feb. 2, 1974; and the ministerial decrees of Aug. 2, 1980; Apr. 1, 1983; June 19, 1984).

All proposals up to the present time for solving the problem and satisfying said requirements consist in stop devices placed at the girder structure, at least in number of two and at a point corresponding to the fixed support.

More particularly, coupling devices are known which are designed to absorb longitudinal shifts and arranged so as to connect externally the girder structure to the pier head on the fixed supports side.

As regards side to side shifts, the technique is well known of adding metal or concrete stop means on head of the the pier, such as for instance side stop members or side walls, whose construction is realized outside the common building programs of that kind of works so that it adds to the building costs in a remarkable way.

However, it is to be observed that the stop members arranged at the head of the girder structure, if employed in number higher than one, according to the teachings of the prior art outlined above, would undergo, in the presence of relative side to side or transversal shifts of the heads of adjacent piers, moments of much larger values than the longitudinal actions for which the devices have been designed.

Moreover, the technique of arranging the device externally to the girder structure which is fixed, within the space between a pier head and the other one of two adjacent bays, again according to the suggestions of said prior art, brings about the drawback of a space of about one meter or more to be left between the pier heads, and in addition, because of the long size of the lever arm of the seismic forces with respect to the rest plane of the girder structure, it increases the stresses on the antiseismic device.

Moreover, because of the presence of fixed type supports for the girder structures, the earthquake shock exerts its action direct on the stiffest parts (fixed supports) before the antiseismic device can act, which device cannot by all means be stiffer than the support itself, as it is to be sufficiently elastic to allow, as is well known, the elastic deformations due to the bending of the girder structures to occur.

Attempts have conventionally been unsatisfactory in avoiding the drawback of the couples of forces caused by the relative transversal shifts of the head of adjacent pier heads through the use of one only stop member which is in this case, also arranged at the girder structure, because this only member is to counteract the full seismic force so that its sizes should be quite incompatible.

In order to solve all such problems, an antiseismic stop device is needed which is capable of allowing a girder structure to rotate freely both in the vertical longitudinal plane and in the horizontal plane, and to slide vertically and longitudinally, and at the same time capable of keeping a head of the pier in a fixed condition, during normal operation periods, and both the girder in the case of earthquake shocks.

The solution to the problem according to the present invention can be advantageously obtained by respecting the following conditions: the seismic shock is to be distributed on both the piers of each bay; the number of the stop members is to be limited to one only member for each head; the stop member is to be arranged at a central position on the pier head; one of the two stop members is to be allowed to move freely longitudinally as a result of the slow deformations of the girder structure caused by thermal changes, or by shrinkage and creep; all supporting devices provided are to be of the movable type.

More particularly, as the longitudinal sliding of the system is to be such as to allow also the slow deformations under static conditions to occur because of thermal changes, shrinkage and creep without giving rise to remarkable reactions, and at the same time said sliding should respond to the strong stresses under dynamic conditions with instantaneous reactions which are a function of the shock speed. The proposal made according to the present invention provides said stop device with a double-action piston chamber, said chamber being filled with a fluid of a very high viscosity and almost constant properties with changing temperature.

In the case in question, in which a girder structure is contemplated that is simply resting on movable supports at points corresponding to the movable head, the piston provided in the device according to the present invention is supplied with longitudinal slits through which the fluid flows out of a chamber into another one, under the action of the slow stresses only; whereas fluid flows under the force of fast stresses at a negligible degree. In the case of earthquake shocks, the minimum shift allowed corresponds to the compressibility of the fluid.

Again according to the present invention, a further antiseismic stop device is placed at a point corresponding to the fixed girder of the girder structure, said device having a double-action piston which in this case bears no longitudinal slit for the fluid flow, so as to allow just the minimum shift corresponding to the compressibility of the fluid and thus to block said girder.

Accordingly, it is a specific object of the present invention that of supplying an antiseismic stop device for girder structures of bridges, viaducts and the like, wherein said girder structure is simply supported on the piers, said device comprising separate stop means, one means for each single girder structure, respectively at points corresponding to the movable and the fixed girder, said means being arranged centrally with respect to the intrados of said girder structure and comprising a central body having a parallelepiped shaped base resting in the lower part; and, by means of sliding members, on a coupling of a convex spherical member with a concave seat which occurs on the bottom plate, said central body being provided in the upper part with vertical pin means which are designed so that they can couple slidably with a first cylindrical seat that is made integral with a slidable counterbox. The counterbox slides in turn, within a second cylindrical seat which is integral with the girder structure. The central body is also provided with a threaded longitudinal hole in its central point. Double-action piston means are housed slidably at the end of said hole, the piston means divided by its drum head having a number of longitudinal slits. The central part of said longitudinal hole has two chambers containing a high viscosity fluid. Hollow cylindrical means are provided on opposite sides of the external surface of the piston, said cylindrical means being externally threaded for allowing the engagement with said inside threading of said hole in correspondence to the end portions of said piston, which are in the shape of a spherical bowl. The cylindrical means are matched by plate members with external portions bearing concave seats for the coupling with said spherical bowl portions of the piston heads, said plate members sliding on the side surfaces of girder members which act as matching means for the longitudinal stresses. The plate members are rotatably housed by means of pins within impact sides which are arranged in a direction parallel to the piston axis and are supplied in their lower parts with longitudinal teeth and tabs matching said bottom plate which is made integral with said impact sides as well as with the pier head through fastening means. Layers of a material consisting of a hard reinforced rubber are interposed between said impact sides and said parallelepiped-shaped body.

According to a preferred embodiment of the present invention, said first cylindrical seat with which the vertical pin couples is made integral with said slidable counterbox by means of a mortar layer or a resin layer provided between said cylindrical seat and the counterbox.

Preferably the double-action piston rod is divided into three parts which are linked to one another through two pins arranged along the axis which make it easier to extract said prismatic base central body from its housing.

According to a preferred embodiment of the invention, the hollow cylindrical means are placed on the outside surface of the piston and consist of bearings supplied with gaskets.

Again, according to a preferred embodiment of the invention, the fastening means provided between the bottom place and said impact sides are made up of a fastening screw that couples with an anchoring bushing welded on said bottom plate, and of a anchoring bolt supplied with an anchoring plate.

The layers of said reinforced hard rubber material interposed between said transversal impact sides and said base parallelepiped-shaped body are advantageously made up of impact plates consisting of a neoprene reinforced rubber.

It is clearly evident that the longitudinal seismic impact force is distributed by the device according to the present invention over both girder structure with a consequent substantial decrease of the localized forces, so that remarkable advantages are obtained.

In addition to the elimination of costly and cumbersome transversal limiting or stopping side members such as side walls and the like, the device according to the present invention, as a result of the lack of clearances or slacks in its component parts as well as of its compact shape, counteracts the transversal seismic shock at the very moment it surges up, and at the same time it prevents relative shifts from occurring between the girder structure and the piers to which said structure is coupled, thereby avoiding any damage to the supporting devices and to the joints.

Moreover, the presence of a convex spherical member against a concave seat member in the device allows the supporting axes of the girder structure to move rotatably in a free way under the action of accidental overloads as well as the head of adjacent piers to shift transversally with respect to each other, also at a remarkable extent, so avoiding the possibility of dangerous reaction couples at the existing supports which are all of the movable type as already pointed out above.

For the reason given above, the longitudinal relative motions are also counteracted at the same time, as the system of constraints prevents the piers from oscillating under the action of the longitudinal component force of the earthquake shock jet, allowing the sliding motion caused by the thermal actions and by the slow deformations.

More particularly, it is to be observed that the vertically slidable double-box structure housed within said girder structure in which the device according to the present invention is inserted makes the installation easier in the laying stage of the girder structure, with the possibility of tolerating laying errors of the order of several centimeters.

The structure that has been disclosed herein represents one of the characteristics traits of the present invention and allows also the full disassembling and the possible substitution of said antiseismic device without having recourse to the operation of hoisting the girder structure, said disassembling operation being possibly further made easier by the exploitation of the particular inventive solution consisting in a piston rod divided into three parts.

The stop device according to the present invention which is explicitly designed for employment in bridges and viaducts having simply supported isostatic girder structures, can also be advantageously employed in the case of continuous bay girder structures, but the piston run is to be determined also as a function of the slow deformations corresponding to the length of the continuous bay sections considered.

A constructive variant is proposed as an alternative to the double-action piston means in correspondence to the fixed head of the girder structure, said variant providing, in the parallelepiped-shaped base central body and on the opposite faces, two hollow housings, with a counteracting material layer on their bottoms, in which two cylindrical members are housed whose ends are in the shape of a spherical bowl and matches plate members bearing concave seats external portions, in order to allow the absorption of shifts only resulting from the rotational motion of the central body of the fixed type stop member, with a structure of simpler design.

The present invention is disclosed in the following with particular reference to a preferred embodiment of the same which is illustrated in the enclosed drawings, wherein:

FIG. 1 represents an exploded view of the stop device according to the present invention;

FIG. 2 represents a detail view of FIG. 1 in axonometric projection showing the double-action piston within its own seat;

FIGS. 3A and 3B represent respectively a top view of the device of the Figure installed and a top view of the base plate;

Figure 8A:
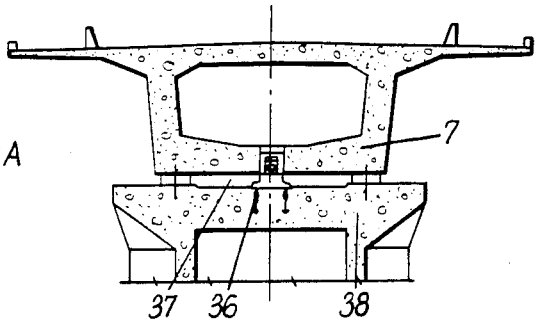
Figure 8B:
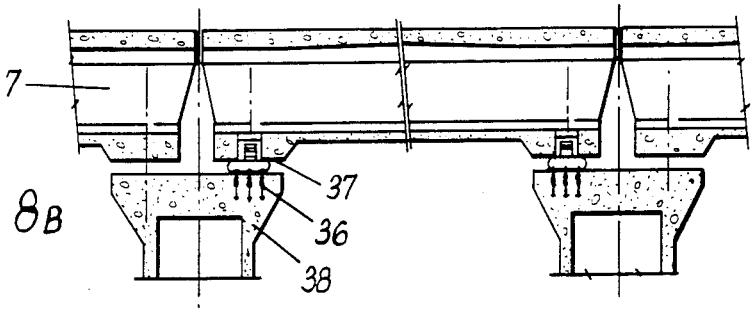
Figure 8C:
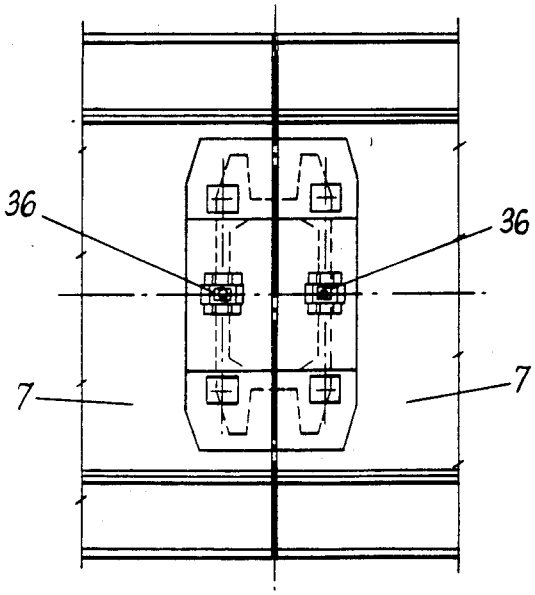
Figure 9A:
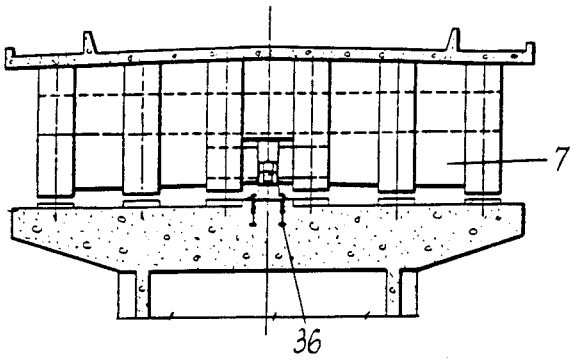
Figure 9B:
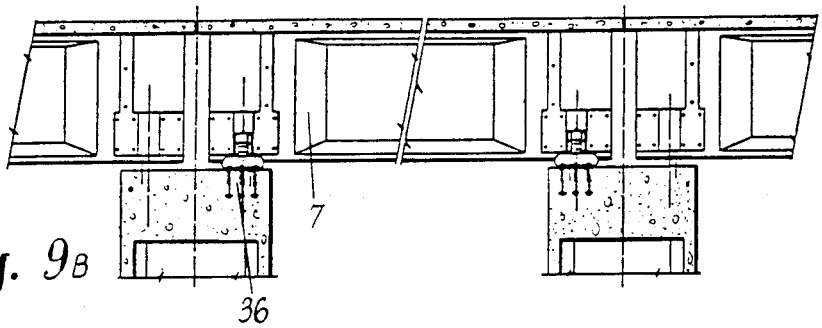
Figure 9C:
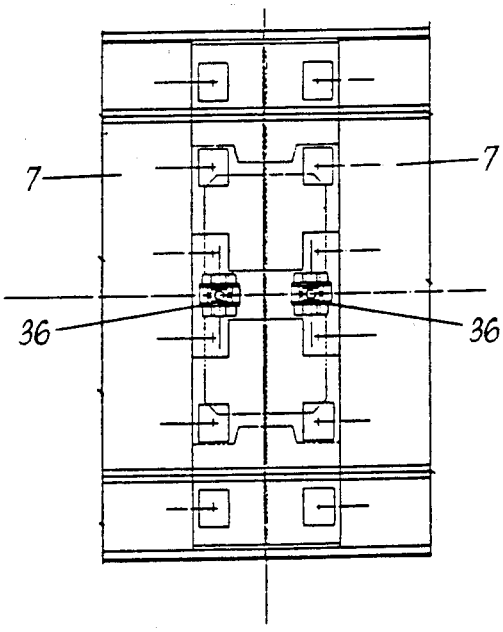

FIGS. 8A, 8B and 8C represent respectively a cross sectional view, a longitudinal cross sectional view and a top view in correspondence to the pier of a caisson-type girder structure, in which structure the device of the present invention is employed; and FIGS. 9A, 9B and 9C represent respectively a cross sectional view, a longitudinal cross sectional view and a top view corresponding to the pier of a beam-type girder structure, in which structure the device of the present invention is employed.

With particular reference to FIG. 1, the device according to the present invention is seen to be divided into the two portions A and B, which are, respectively, integral with the girder structure 7 and the head of the pier. In said portion A, the housing 1 can surround and cover the pin 2 of the parallelepiped-shaped base central body 3, made from 30NiCrMo 12 UNI 7845 steel; which is rigidly connected to a cylindrical counterbox 5 by means of a mortar layer 4 or a resin layer (not shown in FIG. 1), said cylindrical counterbox being slidable within a cylindrical seat or housing 6 which is integral with said girder structure 7. The housing 1 of the pin 2 is provided externally with radially arranged ribs 8 in order to increase the contact surface with the filling material. In the portion B of the device of the present invention it can be observed that said pin 2 is integral with said parallelepiped-shaped base central body 3. The body 3 houses a double-action piston. Said piston may be made from hardened and tempered C40 UNI 7845 steel (see FIG. 2). A rod 9 provided with a drum head 10, whose ends 11 and 12 are in the shape of a spherical bowl and match two caps 13, 14 made up, for instance, of NiCr 18/8 stainless steel. The caps 13 and 14 are slidable against the side surfaces of the longitudinal impact cross-bar members 15 and 16. Two cylindrical bearings 24 and 25, externally threaded, are provided on the outside surface of the rod 9, said bearings being designed for coupling with the corresponding holes of the ends of said parallelepiped-shaped base central body 3. Said cross-bar members 15 and 16 are rotatably housed through pins 17 in the impact sides 18 and 19 which are made integral with the bottom plate 27. The plate 27 can be made employing Fe 430 UNI 7070 steel, and fastened by a fastening system comprising a fastening screw 20 housing within the anchoring bushing 21, the anchoring bolt 22 and the anchoring plate 23. The arrows in FIG. 1 show the vertical, horizontal and longitudinal shifts as well as the rotations on the horizontal and on the vertical longitudinal plane of said stop member. FIG. 3A shows the device of FIG. 1 as fastened to the bottom plate.

Figure 4:
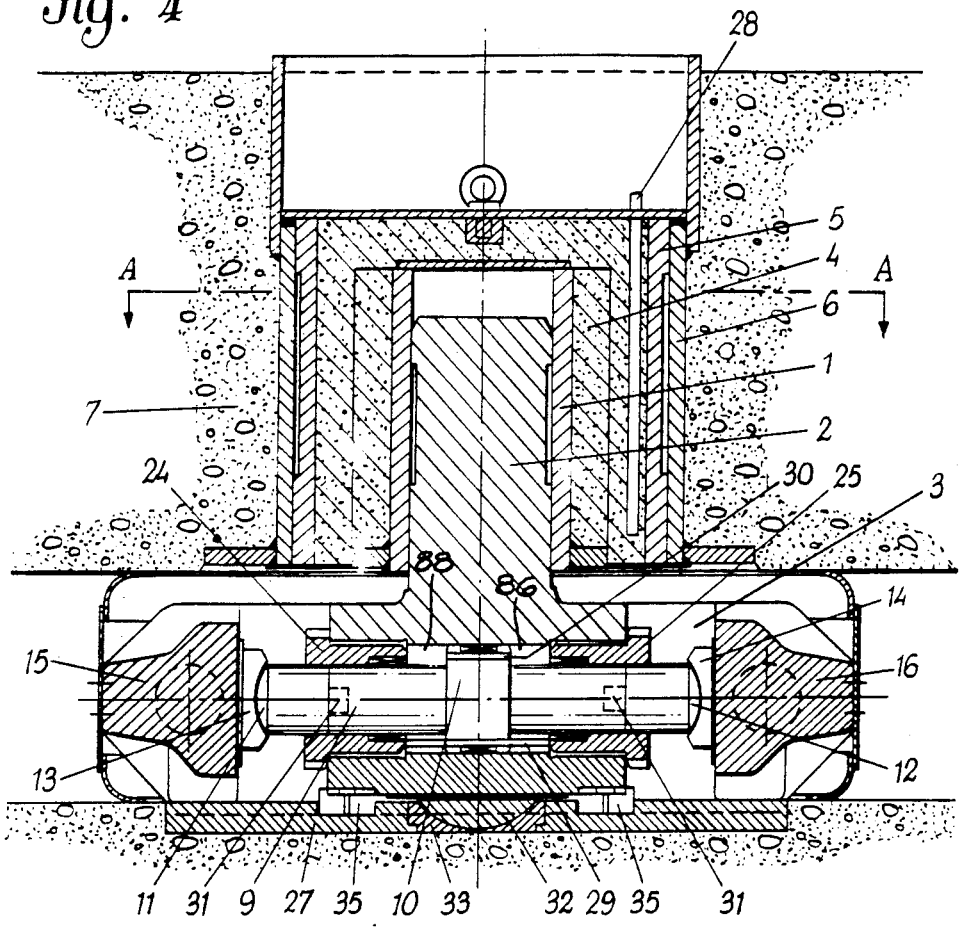
FIG. 4 shows a longitudinal vertical section view of the device of FIG. 1.
Figure 5:
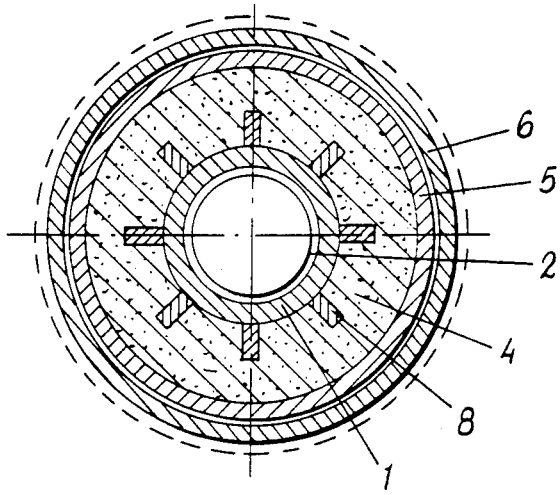
FIG. 5 shows a sectional view taken along the line A—A of FIGS. 4 and 6.
Figure 6:
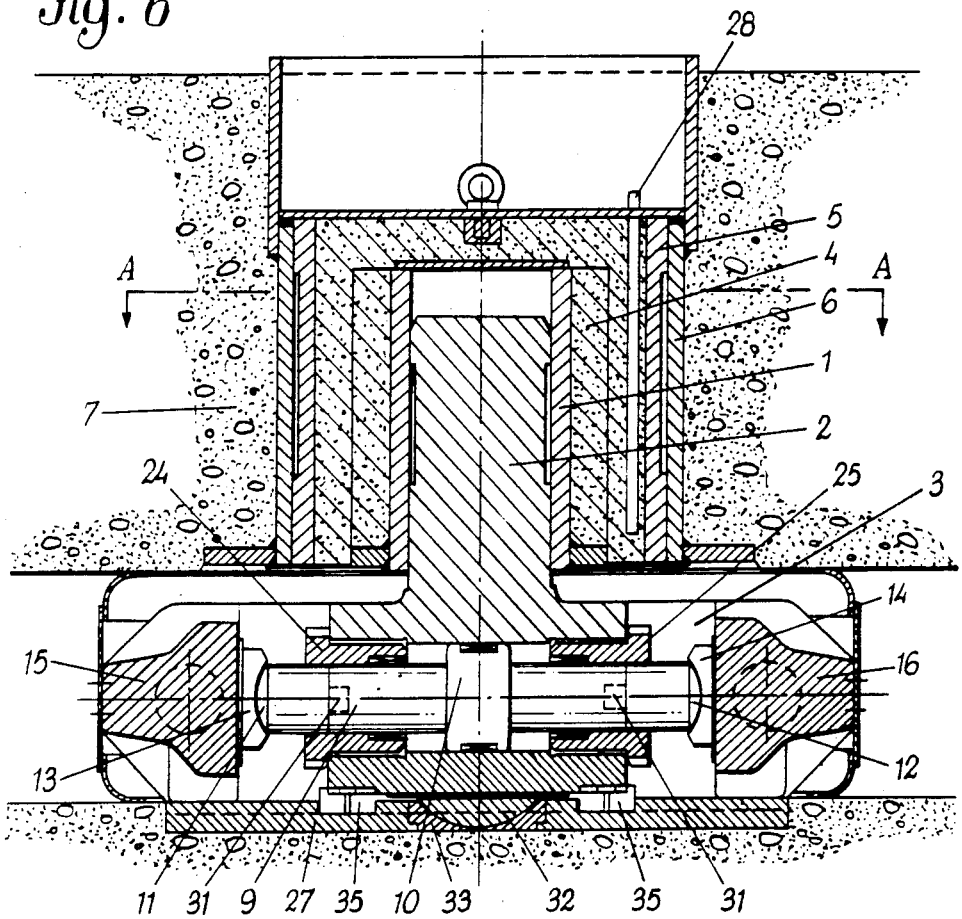
FIG. 6 shows a view similar to that shown in FIG. 4 of a device according to the present invention to be associated to the fixed head.
Figure 6A:
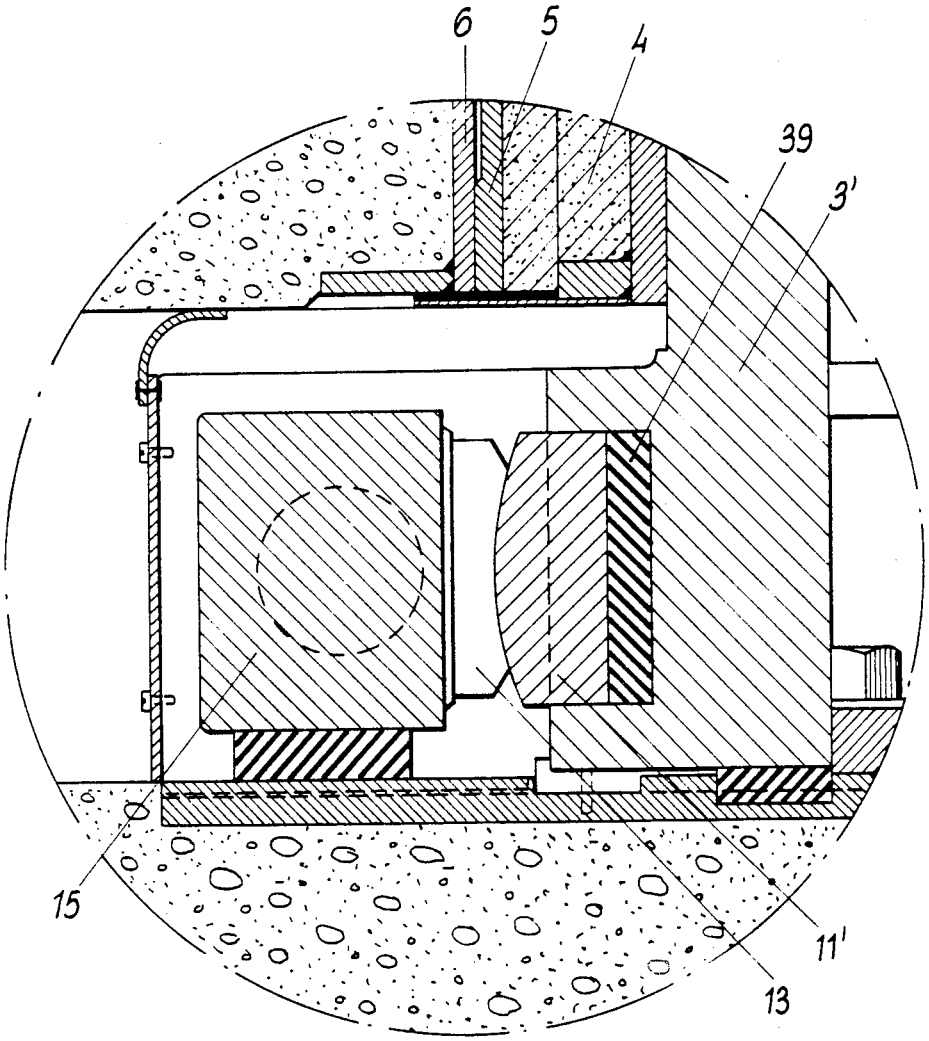
FIG. 6A shows a partial view of a longitudinal vertical section of a detail of the parallelepiped-shaped central body according to an alternative embodiment, to be associated to the fixed head.
Figure 7:
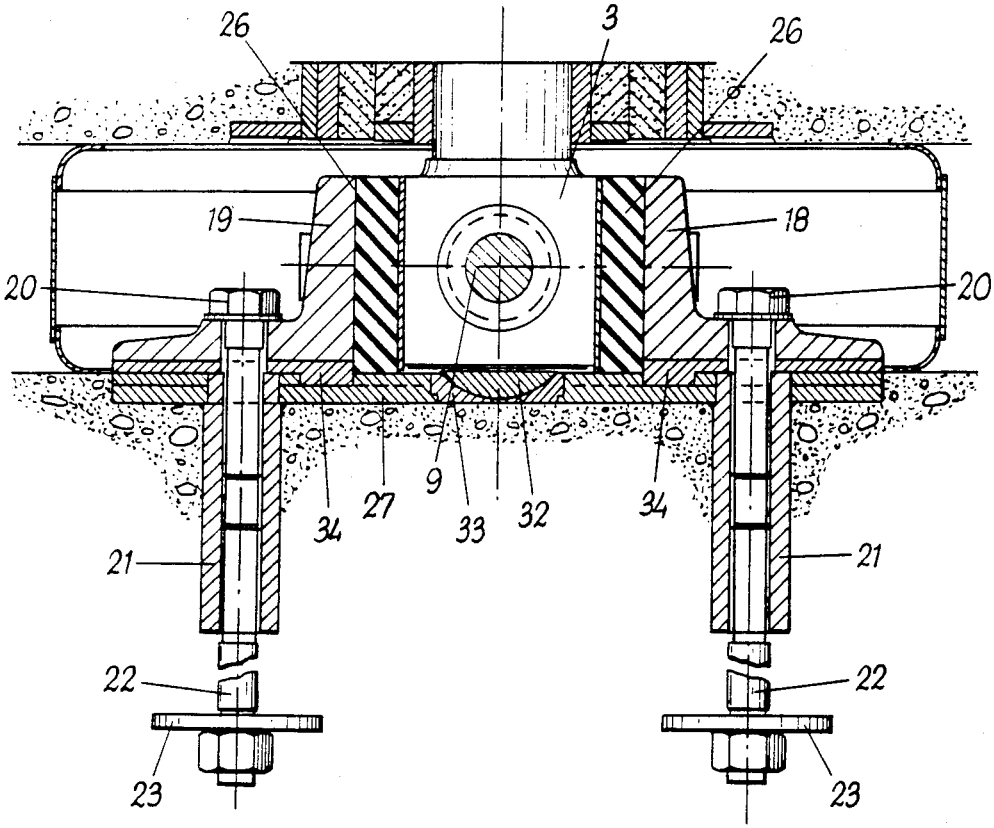
FIG. 7 shows a cross-sectional view of the device shown in FIG. 1 along lines 7—7.

The following members can be observed: the pin 2, which is integral with the parallelepiped-shaped base central body 3, the cylindrical bearings 24, 25 through which the rod 9 of the piston moves; the pin ends 11, 12 as shaped, match the cups 13 and 14 which can slide along the side surfaces of said longitudinal impact members 15, 16 which may be made for instance with FeC 520 UNI 3158 steel, the pins being housed within said impact sides 18 and 19 through the pins 17. The hard reinforced rubber impact plates 26 can also be seen between said body 3 and the impact sides 18 and 19. The plates are fastened to the bottom plate 27 by screws 20 and being preferably are made up of an elastomer-based rubber with steel sheets. FIG. 3B shows more clearly the bottom plate 27 with its anchoring bushing 21 and the holes of the anchoring bolt 22 for fastening the impact sides 18, 19 (not visible). In FIGS. 4 and 6 the device of FIG. 1 is viewed so that the material 4 is utilized making the housing of 1 of the pin 2 integral with said counterbox 5, said material being inserted into the hollow space through the injection tube 28. FIG. 4 also shows details of the longitudinal slits 29, 30 which are formed in the drum 10 and allow a high viscosity fluid to pass from one chamber 86 of the double-action piston to another 88. FIG. 6 also allows that said drum 10 has no such slits. According to the embodiment shown, said rod or stem 9 is divided into three parts which are connected to each other by means of the axial pins 31. A convex spherical member 32 (which may be made from NiCr 8/8 stainless steel) is housed within a concave seat 33 of the bottom plate 27. FIG. 6A makes it possible to observe an example of an alternative embodiment of the central body 3' whose shape is such as to contain, in substitution of the rod 9 with its ends 11, a similar member whose end is pointed out by 12. Such end, on its external side matches the cup 13 which can slide on the side surface of the cross-bar member 15, and, on the other side, a layer 39 is of a counteracting material, preferably of the Adiprene type, the Erlaton type and the like. FIG. 1 allows observance of details of the coupling system having two fundamental parts A and B. The device is made up of a system where all cylinders are manufactured with Fe510 UNI 7070. FIG. 7 shows the supporting system of the impact sides 18, 19 with the bottom plate 27 against longitudinal teeth 34 and tabs 35 (see FIGS. 4 and 6); and in contact with the spherical ball joint 32 which is housed within the concave seat 33 obtained in the bottom plate 27. The fastening system between the impact sides 18, 19 and the bottom plate 27 includes the fastening screws 20 housed in the anchoring bushing 21, the anchoring bolt 22 and the anchoring plates 23. FIGS. 8A, 8B, 8C and 9A, 9B, 9C show the particular arrangement of the device 36 according to the present invention at the intrados 37 of the girder structure 7; and, centrally with respect to said structure on the pier 38. Also shown is the arrangement of two devices 36 for two consecutive bays of the caisson-type or box-type girder structure 7 (FIG. 8C) and of beam-type girder structure (Figure 9C).

EXAMPLE

The present invention is illustrated in the following with reference to an example of a preferred embodiment of the same, in which antiseismic stop members are considered of 120 metric tons for railroad bridge girders (one member for each girder structure head).

Inspection static tests were carried out for the various constituent members of the device, said tests having given the results that are reported in the following as regards the stress and the specific tension characteristics.

For the various members and components, preferred materials were employed whose kind and the corresponding permissible tensile stress are pointed out.

THE STOP MEMBER OF THE MOVABLE TYPE THE CROSS-BAR MEMBER

The longitudinal action of the device

Bending moment at the central line: $M_{T1}=12{,}600{,}000$ kg mm.

Shearing stress at the central line: $T_{T1}=60{,}000$ kg.

Maximum tensile stresses at the central line of the girder are:

$$\sigma T1=18.85 \text{ kg/mm}^2$$

$$\tau T1=3.94 \text{ kg/mm}^2$$

and the ideal tensile stress is: $\sigma_{iT1}=6.82$ kg/mm$^2$.

Bending moment at the fixed end section of the supporting pins: $M_{T2}=1{,}500{,}000$ kg mm.

Shearing stress: $T_{T2}=60{,}000$ kg.

Maximum tensile stresses: $\delta_{T2}=15.27$ kg/mm$^2$; $\tau_{T2}=10.57$ kg/mm$^2$.

Ideal tensile stress: $\sigma_{iT2}=18.30$ kg/mm$^2$.

The manufactured article employed is an Fe 510 UNI 7070 type steel, the permissible tensile stress of which is:

$$\sigma_p=21 \text{ kg/mm}^2$$

THE SIDE PART (a) The transverse action on the device

The transverse action F is 120,000 kg.

On the most stressed section:

Bending moment: $M_F=8{,}250{,}000$ kg mm.

Shearing stress: $T_F=50{,}000$ kg

Maximum normal tensile stress: $\sigma_F=20.53$ kg/mm$^2$.

Maximum shear stress: $\tau_F=7.77$ kg/mm$^2$.

Ideal tensile stress: $\sigma_{iF}=13.45$ kg/mm$^2$.

(b) The longitudinal action on the device:

The most stressed part of the side structure is that of the supporting hole of the cross bar member pin.

Maximum load on each pin: $R_T=60{,}000$ kg.

Maximum normal tensile stress: $\sigma_{FTX}=13.76$ kg/mm$^2$.

Shearing stress: $\tau_{FT}=10.59$ kg/mm$^2$.

Ideal tensile stress: $\sigma_{iFT}=18.34$ kg/mm$^2$.

The same material can be employed as that used for realizing the cross-bar member, if said piece is a carpentry work, or otherwise the steel to be employed for the casting piece is to be of mechanical properties not lower than those of an Fe 510 D UNI 7070 type steel.

FOUNDATION BOLT

Maximum load on the bolt: $R_B=50{,}000$ kg.

Screws to be employed: M 52×3 UNI 5740-65.

Normal tensile stress: $\sigma_v=27.32$ kg/mm$^2$.

The material to be used for the screws is to be that of the 6, 8 Class.

THE CENTRAL BODY

Bending moment at the working or useful central line of the lower support:

$M_I=23{,}583{,}337$ kg mm.

Maximum shear stress at the lower support: $T_I=F=120{,}000$ kg.

Maximum normal tensile stress: $\sigma_I=22.56$ kg/mm$^2$.

Maximum shear stress: $\tau_I=4.36$ kg/mm$^2$.

Ideal tensile stress: $\sigma_{iI}=7.55$ kg/mm$^2$.

Maximum shear stress at the upper support: $\tau_s=9.24$ kg/mm$^2$.

Ideal tensile stress: $\sigma_{is}=16.00$ kg/mm$^2$.

As regards the threaded part of the two heads, results are the following:

Maximum normal tensile stress: $\sigma_F=6.15$ kg/mm$^2$.

Maximum shearing stress: $\tau_F=10.01$ kg/mm$^2$.

Ideal tensile stress: $\sigma_{iF}=17.33$ kg/mm$^2$.

Specific pressure on the side of the screw thread:

$$P_{SF}=5.37 \text{ kg/mm}^2.$$

Maximum tensile stress determined on the "CENTRAL BODY" is:

$$\sigma_{mx}=22.56 \text{ kg/mm}^2.$$

For the construction of such item a hardened and tempered steel can be employed of the 40 Cr UNI 5232-64 type.

THE THRUST PISTON

Specific pressure on the spherical head of the stem:

$$p_{ss}=18.86 \text{ kg/mm}^2$$

Maximum pressure of the inside fluid: $P_i=628$ kg/mm$^2$.

At such values of maximum pressure the SELEMASTER gaskets can be employed available from the POLIPAC, which gaskets can be used at operating pressures up to 700 kg/mm$^2$.

Thrust on the shoulder: $F_{ps}=41{,}308$ kg.

Shearing stress: $\tau_{ps}=3.08$ kg/mm$^2$.

Ideal tensile stress: $\sigma_{lps}=5.3$ kg/mm$^2$.

This construction item also can be realized employing the FE 510 UNI 7070 steel.

THE FIXED TYPE STOP MEMBER

Static inspection tests to be performed with such device are to be similar to tests carried out for the movable type stop member, both in the embodiment which provides the employment of a slitless double-action piston, and in the embodiment which provides the two cylindrical bodies built in the base prismatic body.

It is to be reminded that in the inspection of the device of the fixed type, the operation stresses have a very relevant bearing, which stresses, through much lower than those arising as a result of a seismic shocks, are much more frequent.

The present invention has been disclosed with particular reference to some specific embodiments of the same, but it is to be understood that modifications and changes can be introduced by those who are skilled in the art without departing from its spirit and scope for which a priority right is claimed.

I claim:

1. An antiseismic stop device for bridge and viaduct girder structures, on which of any of said structures, said girder rests on the piers, said device comprising:

a first and a second stop means for each single bridge girder arranged respectively at a point corresponding to a girder slidably connected to a first pier and at a point corresponding to another girder, rigidly connected to a second pier;

each of said stop means being arranged centrally with respect to the intrados of said girder and comprising a central body with a parallelepiped-shaped base resting at its lower face, on sliding members, said sliding members including a coupling of a spherical convex member with a concave seat provided on the bottom plate;

said central body having, at its upper part, vertical pin means adapted for slidably coupling into a first cylindrical seat which is rigidly connected to a counterbox, said counterbox being, in turn, slidably arranged within a second cylindrical seat rigidly connected to said girder structure;

said body having at its upper part a vertical pin means and a longitudinal hole for receiving a threaded piston means at its end portions, said piston means being slidably housed within said longitudinal hole and having a central drum-shaped portion dividing said longitudinal hole into two chambers containing a high viscosity fluid, and hollow cylindrical means at opposite sides of the external end portions of the piston means;

said cylindrical means being externally threaded to engage with said end portions of said hole, the end portions of said piston being convex-shaped which coupled with plate members having concave external seat portions;

impact members having side surfaces for slidably coupling with said concave seat portions, said impact members provided for absorbing longitudinal forces, said impact members being rotatably housed by means of pins within two impact elements, each having a vertical flange extending parallel to the piston axis and a horizontal flange provided at their lower face with a plurality of longitudinal teeth, each tooth engaging within a groove of a bottom plate, fastening means being provided to fasten said impact elements to said bottom plate and to the pier head; and a plurality of layers of hard reinforced rubber materials being interposed between said impact elements and said parallelepiped-shaped base body.

2. An antiseismic stop device for bridge and viaduct girder structures according to claim 1, wherein said first cylindrical seat coupled with the vertical pin is rigidly connected with said slidable counterbox by means of a layer of mortar.

3. An antiseismic stop device for bridge and viaduct girder structures according to claim 1, wherein the stem of said double-action piston is divided into three parts which are connected to each other by means of two pins arranged along its axis.

4. An antiseismic stop device for bridge and viaduct girder structures according to claims 1, 2, or 3, wherein said hollow cylindrical means defined on the inside surface of the piston further comprises bearings having gaskets.

5. An antiseismic stop device for bridge and viaduct girder structures according to claim 1 wherein said fastening means between the bottom plate and said impact element comprises a fastening screw coupled to both an anchoring bushing, which is welded to the bottom plate, and a screw spike, which is provided with an anchoring plate.

6. An antiseismic stop device for bridge and viaduct girder structures according to claim 1, wherein the layers of a hard reinforced rubber material interposed between said impact elements and said base parallelepiped shaped body comprises reinforced neoprene rubber impact plates.

7. An antiseismic stop device for bridge and viaduct girder structures, in which structures the girder rests on the piers, said stop device comprises:

stop or check means installed at a point corresponding to the stationary girder structure itself and centrally with respect to the intrados of the same;

said stop device further comprising:

a central body having a parallelepiped-shaped base resting at its lower part, through slidable means, by coupling a convex spherical member with a concave seat on the bottom plate, said body being provided at its upper part with vertical pin means which are designed for slidably coupling with a first cylindrical seat which is rigidly connected with a slidable counterbox and is placed within a second cylindrical seat rigidly connected with said girder structure;

said first cylindrical seat having on one of its opposite faces which opposes said counterbox which engages said second cylindrical seat at a layer of a mortar material;

plate-shaped members having an external concave seat for coupling with two hollow housing portions, the ends of said housing portions being convex-shaped to slide on the side surfaces of beam members which absorb longitudinal forces and are rotatably housed by means of pins within impact elements arranged parallel to a piston and provided each at its lower face with a plurality of longitudinal teeth each engaging within a longitudinal groove of said bottom plate, and at its side face, each beam member having a wing which matches said bottom plate, said bottom plate being fastened to both said impact members and pier by means of fastening members, said fastening members including a plurality of layers of a hard reinforced rubber material being interposed between said impact elements and said base of the parallelepiped-shaped body.

8. An antiseismic stop device as claimed in claim 1, wherein said central drum-shaped portion of said piston means of said girder, is slidably connected to said first pier head; and, two longitudinal slits are provided by said drum-shaped portion, said slits allowing the passage of said high viscosity fluid from one chamber to another, so that a double action piston is obtained.

* * * * *